US006230988B1

(12) United States Patent
Chao

(10) Patent No.: US 6,230,988 B1
(45) Date of Patent: May 15, 2001

(54) WATER NOZZLE

(76) Inventor: Hui-Chen Chao, 75, Liau Tsuo Hsiang, Liau Tsuo Li Lu Kang Chen, Chang Hua Hsien (TW)

( * ) Notice: Subject to any disclaimer, the term of this patent is extended or adjusted under 35 U.S.C. 154(b) by 0 days.

(21) Appl. No.: 09/536,852

(22) Filed: Mar. 28, 2000

(51) Int. Cl.[7] ..... A62C 31/02

(52) U.S. Cl. ..... 239/394; 239/526; 239/436; 239/558

(58) Field of Search ..... 239/390, 391, 239/894, 525, 526, 548, 556, 558, 560, 561, 436, 437, 392

(56) References Cited

U.S. PATENT DOCUMENTS 5,566,886 * 10/1996 Wang ..... 239/526
5,598,978 * 2/1997 Wang ..... 239/394
5,772,121 * 6/1998 Wang ..... 239/394
5,873,531 * 2/1999 Wang ..... 239/394
5,992,762 * 11/1999 Wang ..... 239/394
6,164,566 * 12/2000 Hui-Chen ..... 239/394

* cited by examiner

*Primary Examiner*—David A. Scherbel
*Assistant Examiner*—Christopher S. Kim
(74) *Attorney, Agent, or Firm*—Harrison & Egbert

(57) ABSTRACT

A water nozzle including a main body which is connected to a water discharge tube which is in turn connected with a head seat. The head seat is provided to a water outlet and locating column to which a nozzle cover is fastened by a fastening bolt. The nozzle cover is provided with a plurality of jet holes. A water distribution disk is fastened with the nozzle cover such that the through holes of the water distribution disk are corresponding in location to the jet holes of the nozzle cover. The nozzle cover is provided with a plurality of center jet holes, peripheral jet holes, and peripheral flow holes. The water distribution disk is provided with a plurality of flow guiding holes corresponding in location to the center jet holes, peripheral jet holes, and peripheral flow holes. The water nozzle is thus capable of ejecting water in various forms.

1 Claim, 12 Drawing Sheets

WATER NOZZLE

FIELD OF THE INVENTION

The present invention relates generally to a water distributing device, and more particularly to a water nozzle.

BACKGROUND ART

As shown in FIG. 1, a pistol nozzle of the prior art comprises a main body, a control lever, and a barrel which is fastened at one end thereof to one end of the control lever and is provided at other end thereof with a spray nozzle. Such a prior art pistol nozzle as described above is defective in design because the water stream is apt to be interfered with by the water turbulence, and because the spray nozzle is susceptible to being disoriented, thereby resulting in the water leak.

SUMMARY OF THE INVENTION

The primary objective of the present invention is to provide a water nozzle comprising a nozzle cover and a water distribution disk which is linked with the nozzle cover such that the water distribution disk is turned by the nozzle cover in motion to change the way in which the water is ejected.

The objective, features and advantages of the present invention will be readily understood upon a thoughtful deliberation of the following detailed description of the preferred embodiments of the present invention with reference to the accompanying drawings.

BRIEF DESCRIPTION OF THE DRAWINGS

FIG. 5-1 shows a schematic plan view of the inner side of the nozzle cover of the present invention.

FIG. 6-1 shows a schematic plan view of the inner side of the water distribution disk of the present invention.

FIG. 7-1 shows a sectional schematic view of the jet holes of the nozzle cover of a third preferred embodiment of the present invention.

DETAILED DESCRIPTION OF THE INVENTION

Figure 1:
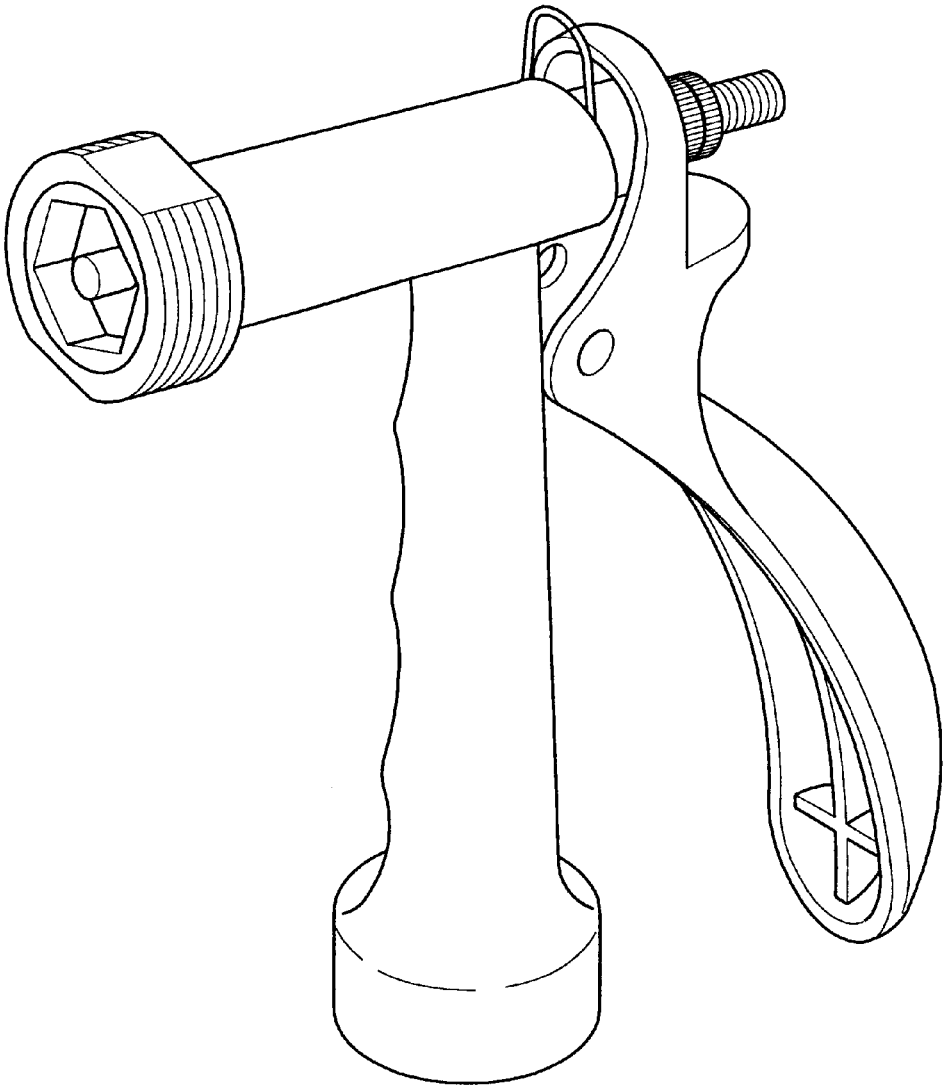
FIG.1 PRIOR ART
FIG. 1 shows a perspective view of a pistol nozzle of the prior art.
Figure 2:
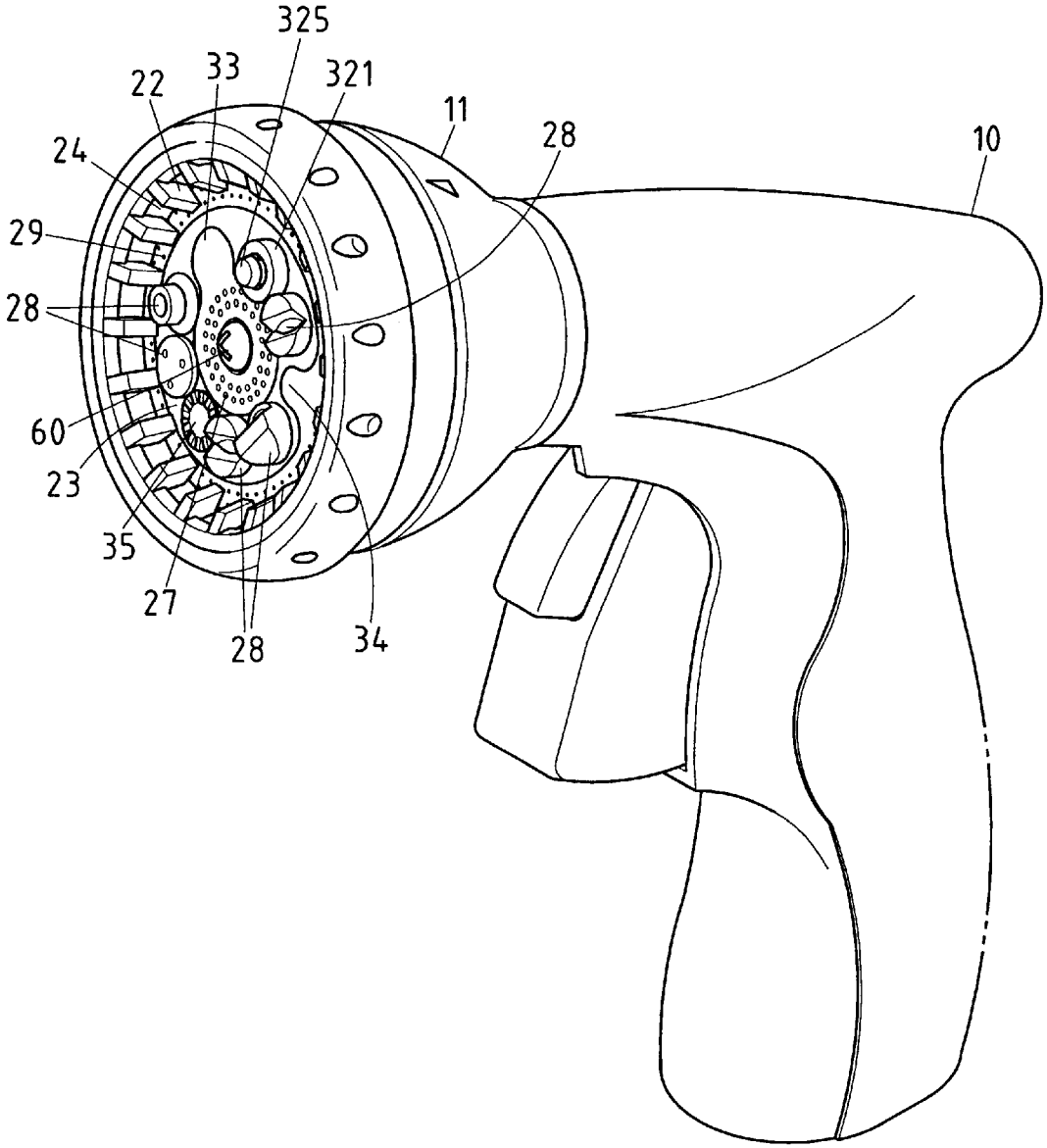
FIG. 2 shows a perspective view of a preferred embodiment of the present invention.
Figure 3:
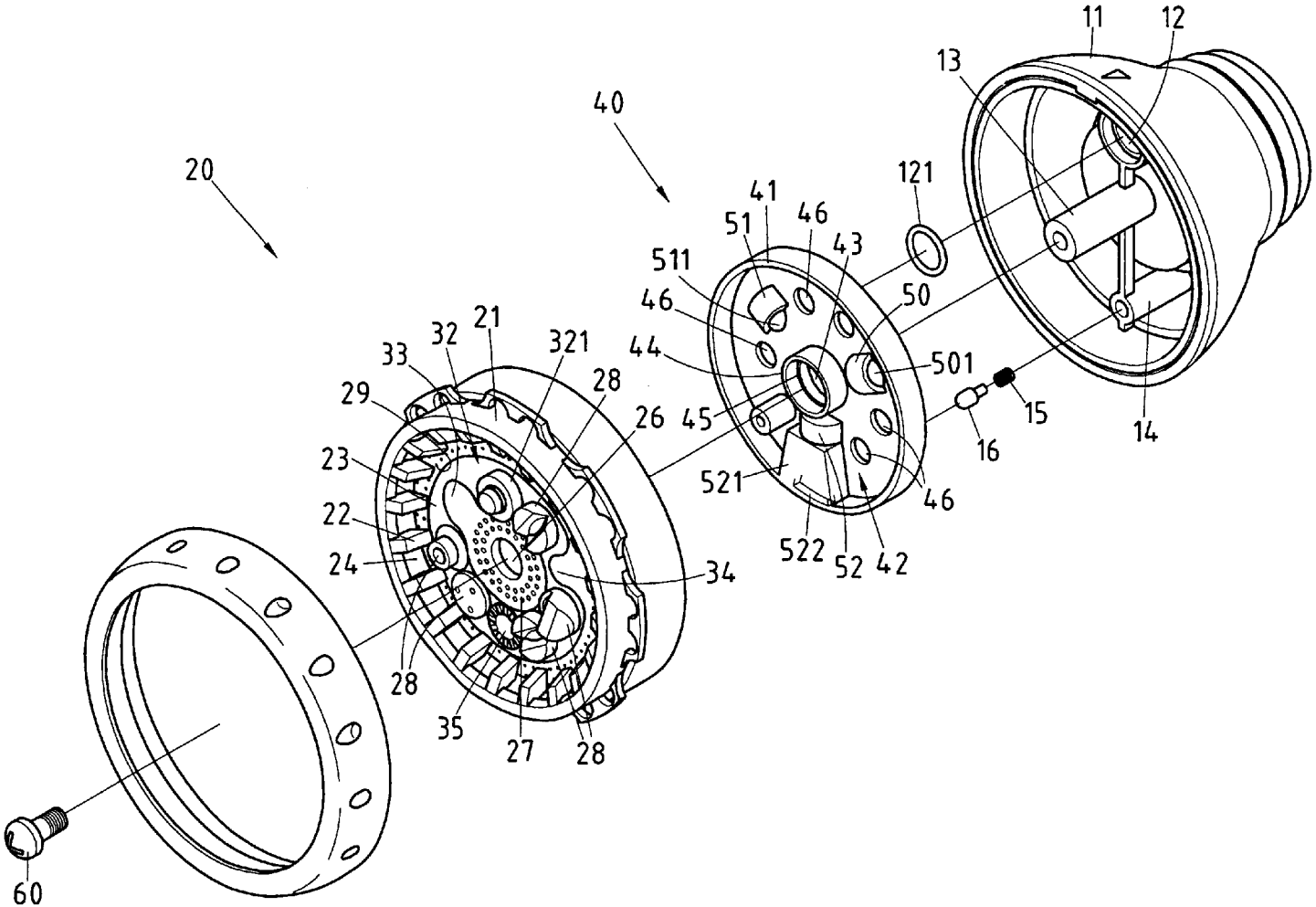
FIG. 3 shows an exploded view of the preferred embodiment of the present invention.
Figure 4:
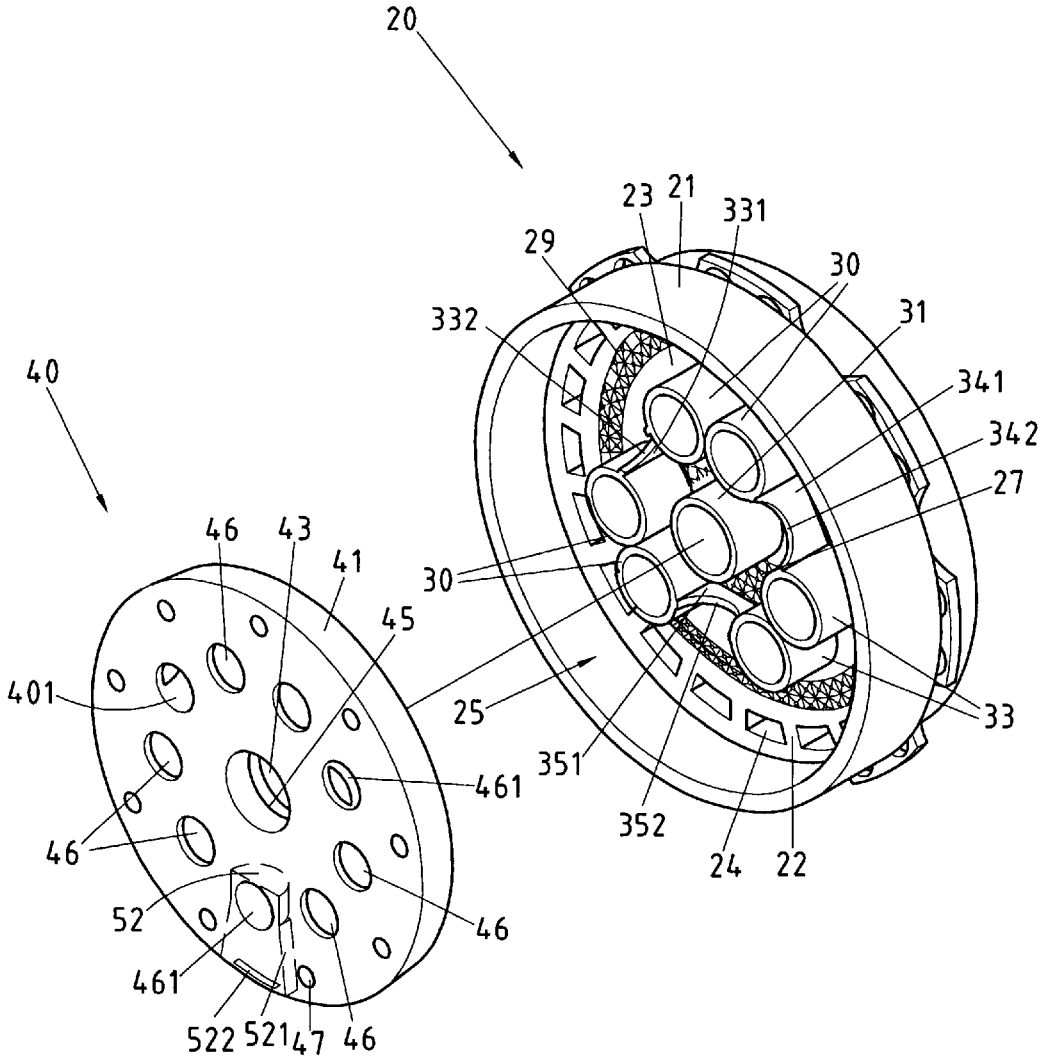
FIG. 4 shows an exploded view of a second preferred embodiment of the present invention.
Figure 5:
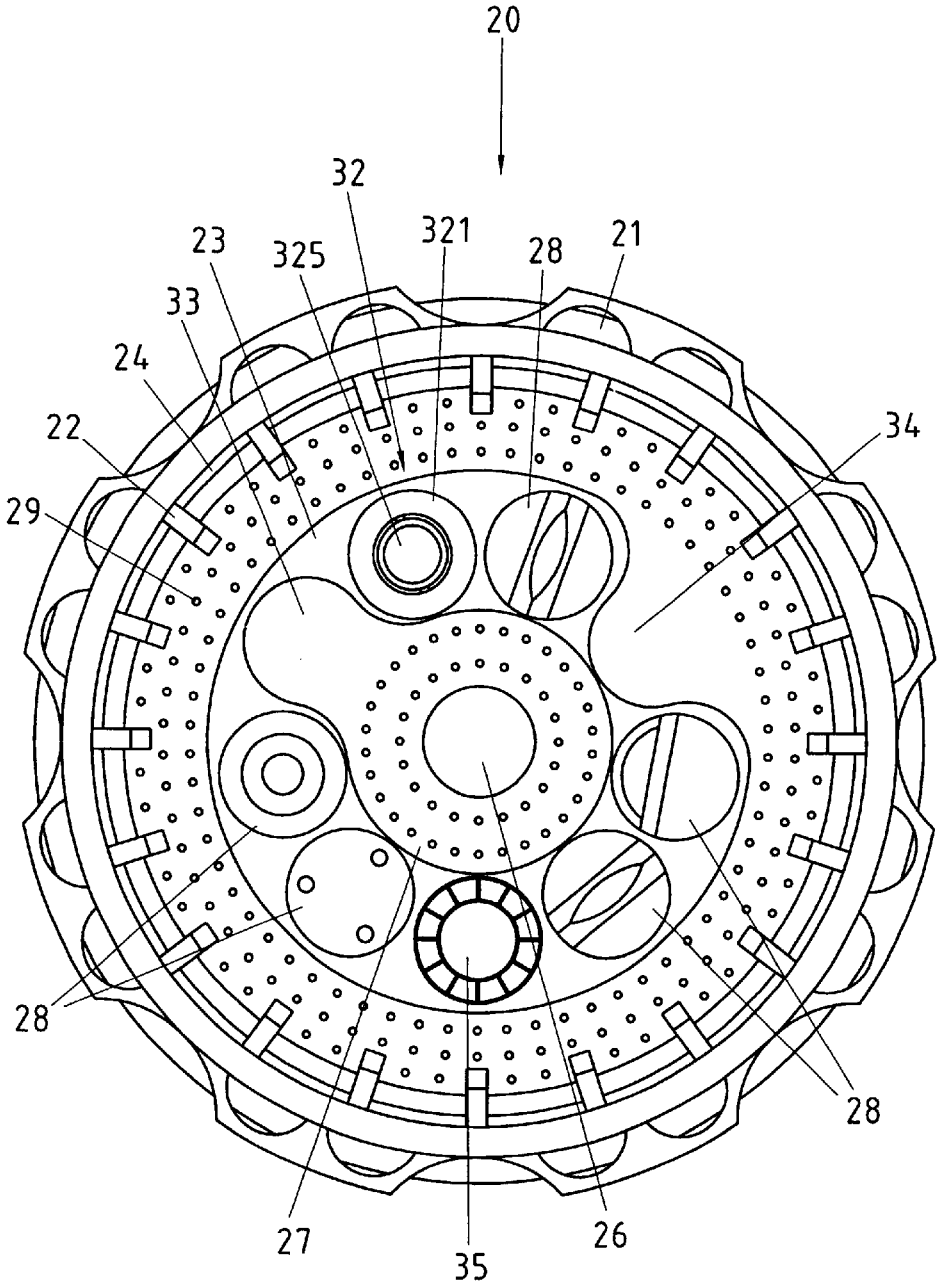
FIG. 5 shows a schematic plan view of the outer side of the nozzle cover of the present invention.
Figures 1, 5:
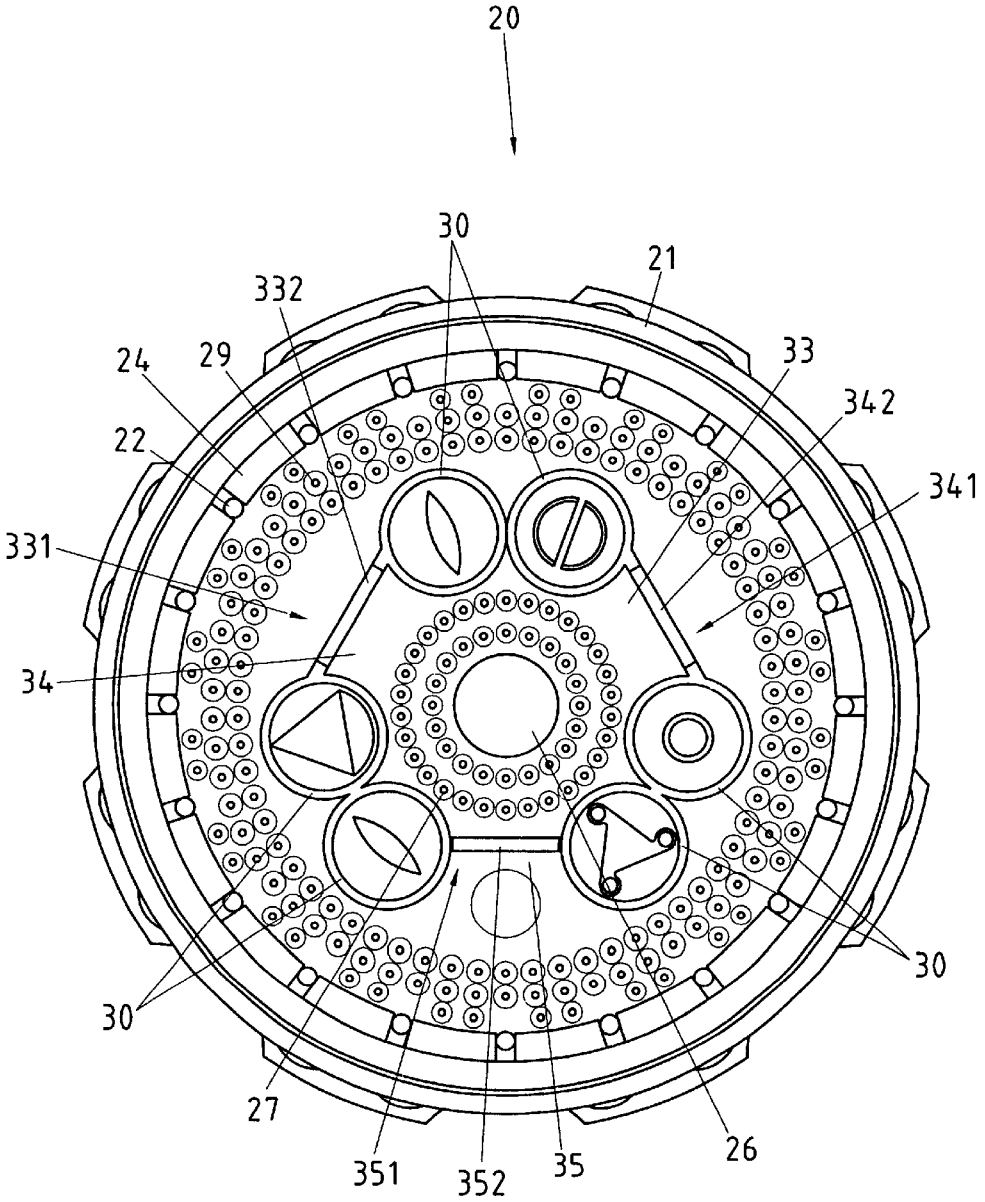
Figure 6:
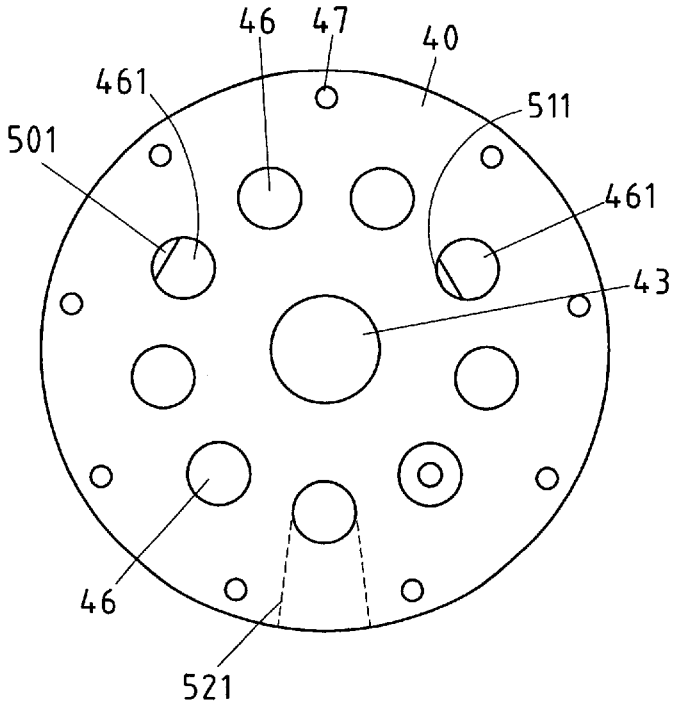
FIG. 6 shows a schematic plan view of the outer side of the water distribution disk of the present invention.
Figures 1, 6:
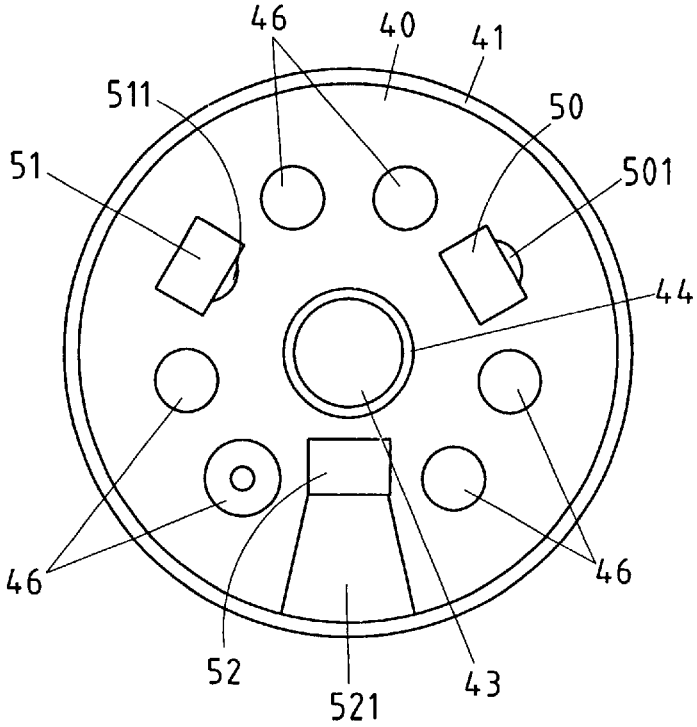

As shown in FIGS. 2–11, a water nozzle embodied in the present invention comprises a main body 10, a nozzle cover 20, and a water distribution disk 40.

The main body 10 is provided with a head seat 11 which is in turn provided with a water outlet 12, a locating tube 13, and a fitting tube 14. The water outlet 12 is provided with a leakproof ring 121. The fitting tube 14 is provided in the interior thereof with a locating bolt 16 having a recovery spring 15.

The nozzle cover 20 has an outer annular body 21 which is provided in the inner wall thereof with a plurality of ribs 22 which are separated from one another and are connected with a face plate 23. A plurality of peripheral flow holes 24 are formed between the outer peripheral edge of the face plate 23 and the front edge of the inner wall of the outer annular body 21. The nozzle cover 20 is provided in the inner side thereof with a recessed space 25. The face plate 23 is provided in the center thereof with a through hole 26 and a number of center jet holes 27. The face plate 23 is further provided with a plurality of jet holes 28 surrounding the center jet holes 27. The face plate 23 is further provided with a plurality of peripheral jet holes 29 and a plurality of tubular bodies 30 and 31.

The water distribution disk 40 is equal in outer diameter to the face plate 23 of the nozzle cover 20. The water distribution disk 40 is provided in the periphery thereof with an annular side 41 and a recessed surface 42. The water distribution disk 40 is provided at the center thereof with a locating hole 43 and an annular body 44 corresponding to the through hole 43 of the water distribution disk 40 and the through hole 26 of the face plate 23 of the nozzle cover 20 and having a stop ring 45. The water distribution disk 40 is further provided with a plurality of through holes 46 corresponding in location to the tubular bodies 30 of the face plate 23 of the nozzle cover 20. The water distribution disk 40 is provided in the periphery of the inner side thereof with a plurality of recesses 47, which are arranged in a circle. As the water distribution disk 40 is joined with the face plate 23 of the nozzle cover 20, the nozzle cover 20 and the water distribution disk 40 are disposed on the head seat 11 such that the locating tube 13 is put through the locating hole 26 of the nozzle cover 20, and such that the locating tube 13 is fastened onto by a bolt 60 via the through hole 26 of the nozzle cover 20. As a result, the nozzle cover 20 and the water distribution disk 40 are fastened securely to the head seat 11 of the main body 10. The water distribution disk 40 is linked with the nozzle cover 20 such that the water distribution disk 40 is actuated by the nozzle cover 20 in motion to turn so as to enable the through hole 46 of the water distribution disk 40 to be in communication with the water outlet 12 of the head seat 11. The water is thus ejected from the jet holes 28. In the meantime, the water distribution disk 40 is located by the recesses 47, one of which is engaged with the locating bolt 16 of the fitting tube 14 of the head seat 11.

Figure 7:
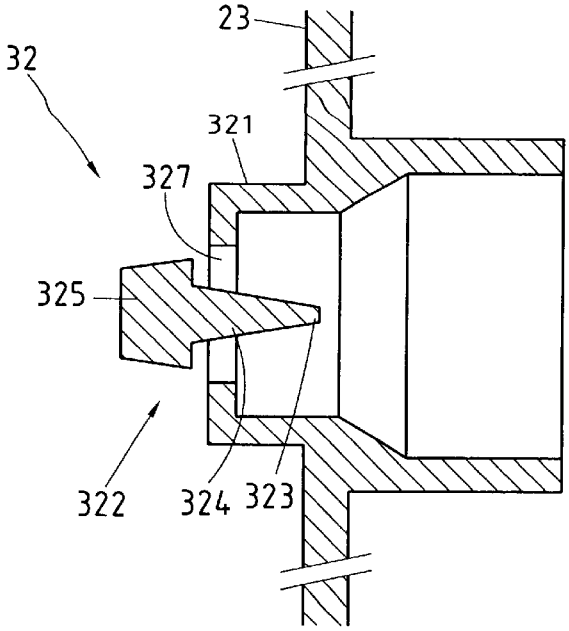
FIG. 7 shows a sectional schematic view of the jet holes of the nozzle cover of the present invention.
Figures 1, 7:
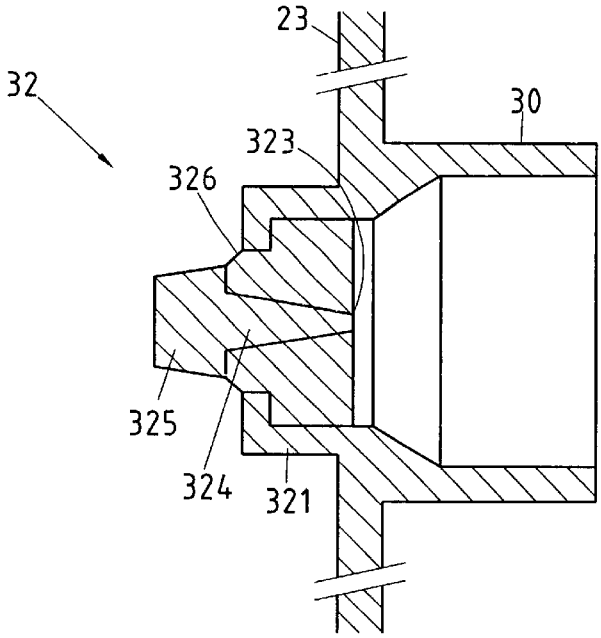

The features of the present invention are described hereinafter. A special jet hole 32 is formed on the nozzle cover 20 is integrally formed by a flow guiding body 322 of protruded ring 321 as shown in FIGS. 7 and 7-1. The flow guide body 322 has a pointed end 323 which is located in the interior of the protruded ring 321 and is provided with a tapered rod 324 having an annular body 325 jutting out of the protruded ring 321. The tapered rod 324 is provided with two wings 326, which are connected to the inner wall of the protruded ring 321 such that a channel 327 is formed between the outer wall of the tapered rod 324 and the inner wall of the protruded ring 321. The jet holes 28 are provided therebetween with at least three separation areas 33, 34, and 35, which are provided respectively with a locating wall 331, 341, 351, with each locating wall being connected with the outer wall of the tubular bodies 30. Each locating wall 331, 341, 351 is provided with an arcuate edge 332, 342, 352.

The water distribution disk 40 is provided with three arcuate bodies 50, 51, and 52, which are corresponding respectively to the arcuate edges 332, 342, and 352. The arcuate body, 50 has a flow guiding hole 501 which faces the annular side 41 of the water distribution disk 40. The arcuate body 51 has a flow guiding hole 511 which faces the annular body 44 of the water distribution disk 40. The arcuate body 52 has a protuberance 521 facing the annular side 41 of the water distribution disk 40. The arcuate bodies 50,51 and 52 are provided with a guide slot 461 in communication with the flow guiding hole 501, 511, 522. As the outer side of the water distribution disk 40 is joined with the inner side of the face plate of the nozzle cover 20, the peripheral jet holes 29 of the face plate 23 and the peripheral flow holes 24 of the face plate 23 are separated by the annular side 41 of the water distribution disk 40 such that the arcuate bodies 50, 51 and 52 of the water distribution disk 40 are engaged with the arcuate edges 332, 342 and 352 of the locating walls 331, 341 and 351, and such that the inner side of the face plate 23 and the outer side of the water distribution disk 40 are sealed off. Furthermore the through hole 46, the guide slot, and the locating hole 43 of the water distribution disk 40 are in communication with the tubular bodies 30 and 31 of the nozzle cover 20, thereby enabling the flow guiding hole 501 of the arcuate body 50 of the water distribution disk 40 to be in communication with the peripheral jet holes 29 of the nozzle cover. The flow guiding hole 511 of the arcuate body 51 of the water distribution disk 40 is in communication with the center jet holes 27 the nozzle cover 20, the flow guiding hole 522 of the arcuate body 52 being in communication with the peripheral flow holes 24 of the nozzle cover 20.

Figure 8:
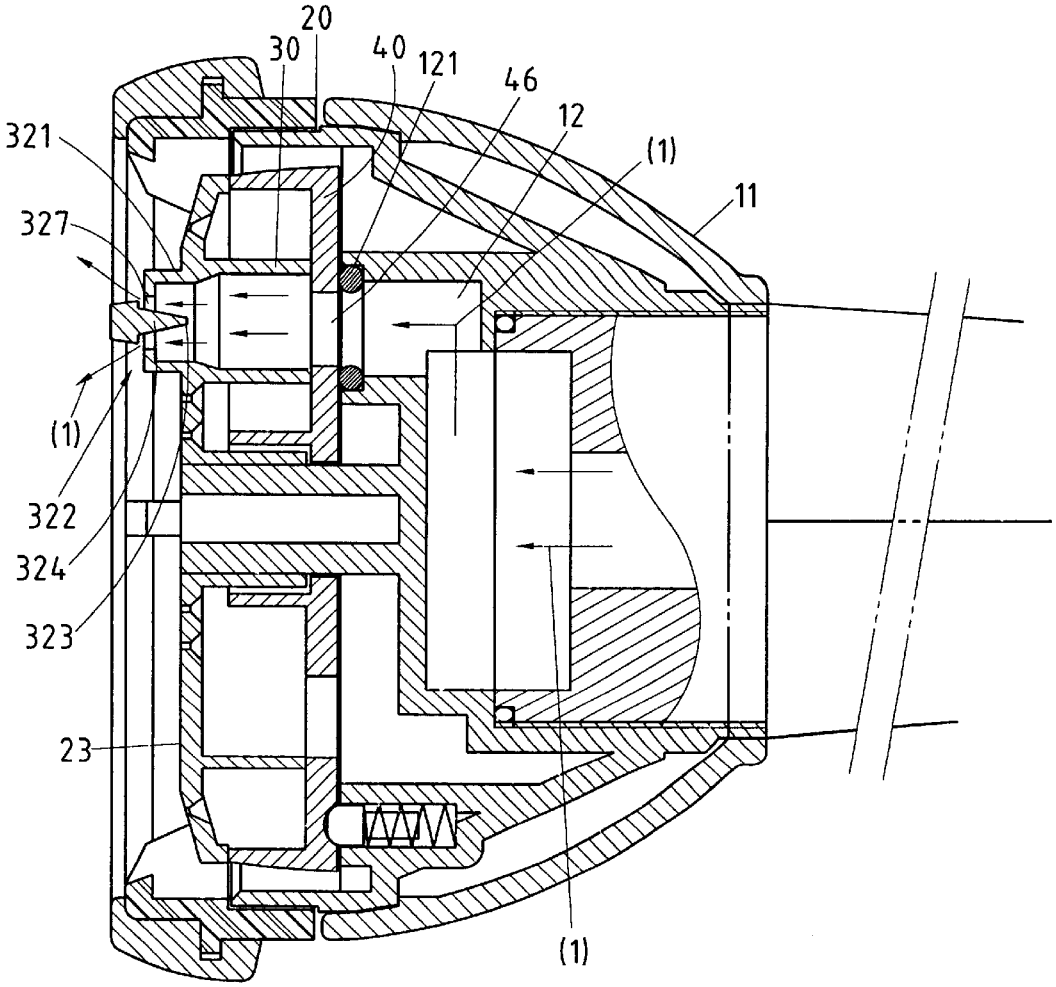
FIG. 8 shows a sectional schematic view of the jet holes of the present invention at work.
Figure 9:
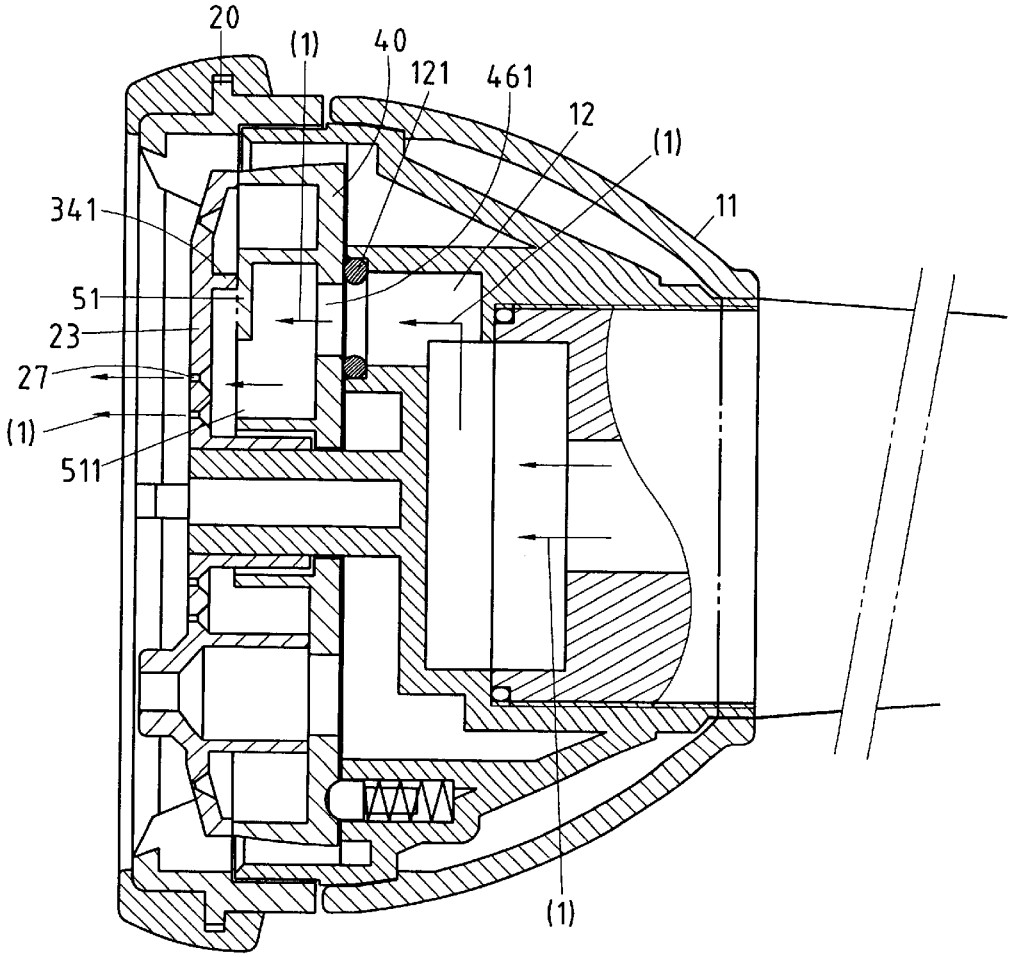
FIG. 9 shows a sectional schematic view of the center jet holes of the present invention at work .
Figure 10:
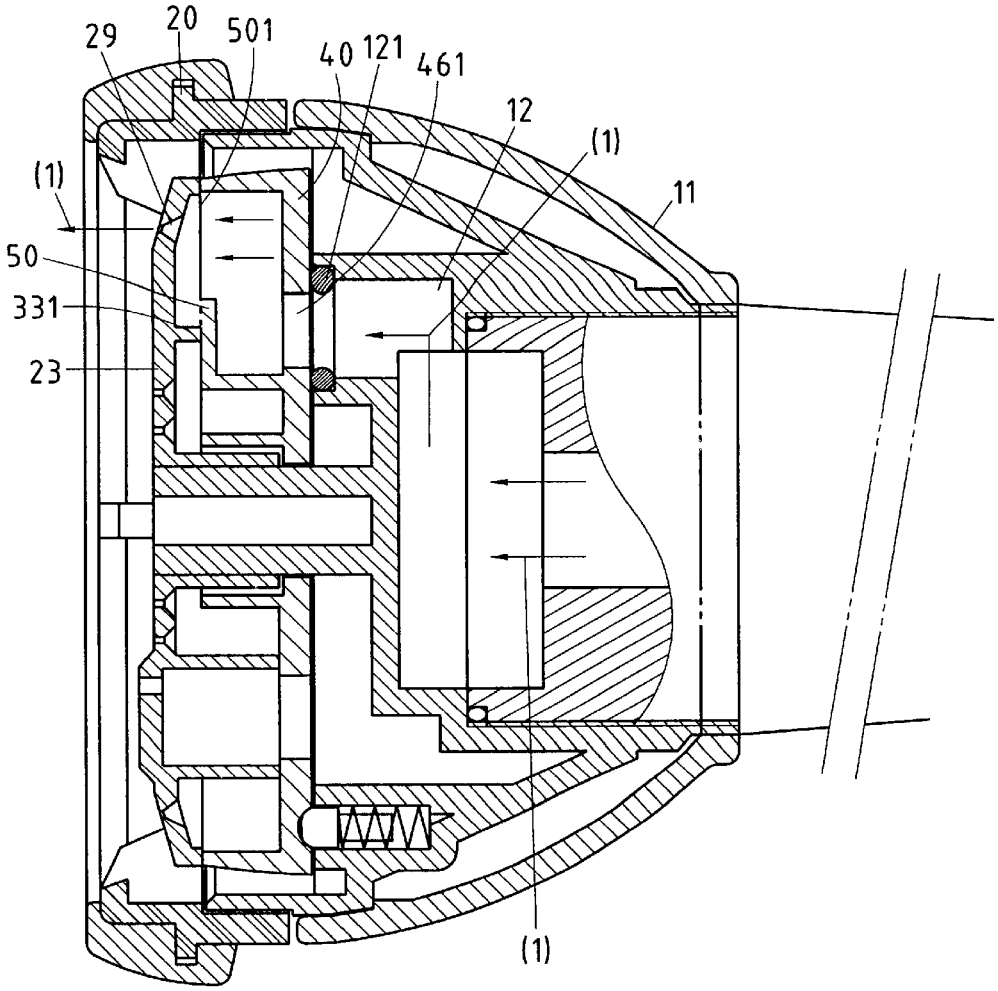
FIG. 10 shows a sectional schematic view of the peripheral jet holes of the present invention at work.
Figure 11:
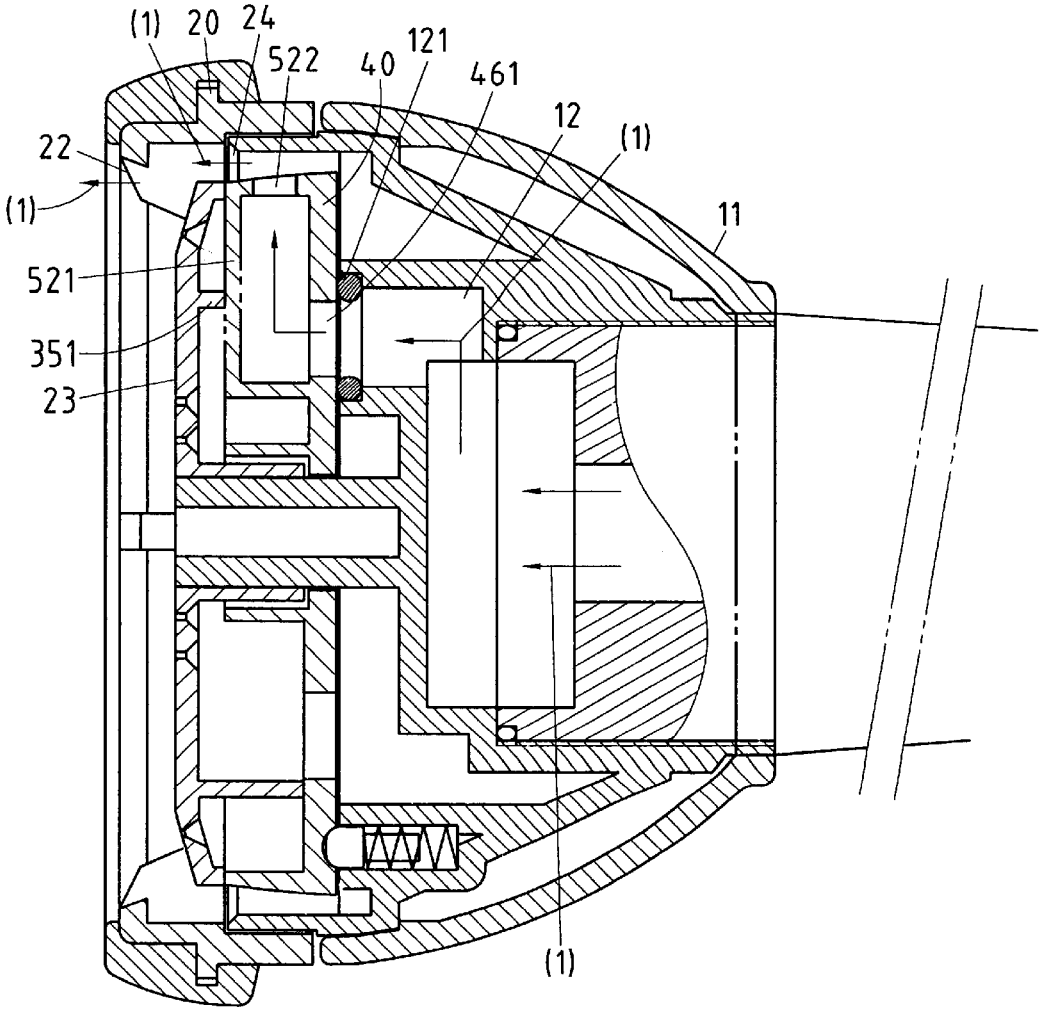
FIG. 11 shows a sectional schematic view of the peripheral flow holes of the present invention at work.

As shown in FIGS. 7, 7-1, and 8, the water flow 1 is guided out of the water outlet 12 and is then guided into the tubular bodies 30 of the nozzle cover 20 via the through holes 46 of the water distribution disk 40. The water flow 1 is subsequently guided by the tapered rods 324 of the pointed ends 323 of the protruded ring 321 to eject in a radiate manner. The water flow 1 is thus free from the interference of the turbulence.

As shown in FIGS. 3, 4, 5, 5-1, 6, 6-1, 9, 10, and 11, the tubular bodies 30 of the nozzle cover 20 are crowded together such that the flow guiding hole 501 of the first arcuate body 50 of the water distribution disk 40 is in communication with the peripheral jet holes 29 of the nozzle cover 20, and such that the flow guiding hole 511 of the second arcuate body 51 of the water distribution disk 40 is in communication with the center jet holes 27 of the nozzle cover 20. Furthermore the flow guiding hole 522 of the third arcuate body 52 of the water distribution disk 40 is in communication with the peripheral flow holes 24 of the nozzle cover 20.

The leakproof ring 121 of the water outlet 12 remains in contact with the inner side of the water distribution disk 40 at the time when the water distribution disk 40 is rotated. As a result, the water distribution disk 40 is prevented from being forced to move aside by the pressure of the water flow.

The embodiment of the present invention described above is to be regarded in all respects as being merely illustrative and not restrictive.

Accordingly, the present invention may be embodied in other specific forms without deviating from the spirit thereof. The present invention is therefore to be limited only by the scope of the following appended claim.

I claim:

1. A water nozzle comprising:

a main body provided with a head seat, said head seat being provided with a water outlet, a locating tube, and a fitting tube, said water outlet provided with a leakproof ring, said fitting tube provided in the interior thereof with a locating bolt having a recovery spring;

a nozzle cover having an outer annular body which is provided in an inner wall thereof with a plurality of ribs, said ribs being separated from one another and connected to a face plate, said face plate and said outer annular body being provided therebetween a plurality of peripheral flow holes, said nozzle cover further provided in an inner side thereof with a recessed space, said face plate provided in a center thereof with a through hole and a number of center jet holes, said face plate further provided with a plurality of jet holes circumventing said center jet holes, a plurality of peripheral jet holes, and a plurality of tubular bodies;

a water distribution disk equal in outer diameter to said face plate of said nozzle cover and having in the periphery thereof an annular side and a recessed surface, said water distribution disk provided in the center thereof with a locating hole and an annular body corresponding in location to said through hole of said face plate of said nozzle cover, said annular body having a stop ring, said water distribution disk further provided with a plurality of through holes corresponding in location to said tubular bodies of said face plate of said nozzle cover, said water distribution disk further provided in a periphery of an inner side thereof with a plurality of recesses which are arranged in a circle, said water distribution disk being joined with said face plate of said nozzle cover such that said locating tube of said head seat is put through said locating hole of said water distribution disk and said through hole of said nozzle cover, and that said locating tube is fastened onto by a bolt via said through hole of said nozzle cover, said water distribution disk being linked with said nozzle cover such that said water distribution disk is actuated by said nozzle cover in motion to turn so as to enable said plurality of through holes of said water distribution disk to be in communication with said water outlet of said head seat, and that said water distribution disk is located by said recesses in conjunction with said locating bolt which is engaged with one of said recesses;

wherein one of said plurality of jet holes of said nozzle cover is are provided with a special jet hole formed integrally by a flow guiding body of a protruded ring, said flow guide body having a pointed end which is located in the interior of said protruded ring and is provided with a tapered rod having an annular body jutting out of said protruded ring, said tapered rod being provided with two wings which are connected to an inner wall of said protruded ring such that a channel is formed between an outer wall of said tapered rod and the inner wall of said protruded ring, said plurality of jet holes further provided therebetween with at least a first separation area, a second separation area, and a third separation area, said first separation area provided with a first locating wall connected to an outer wall of said tubular bodies, said second separation area provided with a second locating wall connected to the outer wall of said tubular bodies, said third separation area provided with a third locating wall connected to the outer wall of said tubular bodies, said first locating wall provided with a first arcuate edge, said second locating wall provided with a second arcuate edge, said third locating wall provided with a third arcuate edge;

wherein said water distribution disk is provided with a first arcuate body corresponding to said first arcuate edge of said first locating wall, a second arcuate body corresponding to said second arcuate edge of said second locating wall, and a third arcuate body corresponding to said third arcuate edge of said third locating wall, said first arcuate body provided with a first flow guiding hole facing said annular body of said water distribution disk, said second arcuate body provided with a protuberance—having a second flow guide hole—, therefore, this change facing said annular side of said water distribution disk, said first arcuate body provided with a first guide slot in communication with said first flow guiding hole, said second arcuate body provided with a second guide slot in communication with said second flow guiding hole, said third arcuate body provided with a third flow guiding hole whereby said water distribution disk is joined with said face plate of said nozzle cover such that said peripheral jet holes of said face plate and said peripheral flow holes of said face plate are separated by said annular side of said water distribution disk, and that said first arcuate body, said second arcuate body and said third arcuate body of said water distribution disk are engaged respectively with said first arcuate edge, said second arcuate edge, and said third arcuate edge, and further that said plurality of through holes, of said water distribution disk are in communication with said tubular bodies of said nozzle cover, thereby enabling said first flow guiding hole of said first arcuate body of said water distribution disk to be in communication with said center jet holes of said nozzle cover, said second flow guiding hole of said second arcuate body of said water distribution disk being in communication with said peripheral flow holes of said nozzle cover, said third flow guiding hole of said third arcuate body being in communication with said peripheral jet holes of said nozzle cover.

* * * * *